United States Patent [19]

Kruse et al.

[11] Patent Number: 4,913,832

[45] **Date of Patent: * Apr. 3, 1990**

[54] DETERGENT COMPACTS

[75] Inventors: Hans Kruse, Korschenbroich; Jochen Jacobs, Wuppertal; Theodor Altenschoepfer, Duesseldorf; Peter Jeschke, Neuss, all of Fed. Rep. of Germany

[73] Assignee: Henkel Kommanditgesellschaft auf Aktien, Duesseldorf-Holthausen, Fed. Rep. of Germany

[ * ] Notice: The portion of the term of this patent subsequent to May 9, 2006 has been disclaimed.

[21] Appl. No.: 302,067

[22] Filed: Jan. 24, 1989

Related U.S. Application Data

[63] Continuation of Ser. No. 144,784, Jan. 20, 1988, abandoned, which is a continuation of Ser. No. 931,764, Nov. 17, 1986, abandoned.

[30] Foreign Application Priority Data

Nov. 21, 1985 [DE] Fed. Rep. of Germany ..... 3541147

[51] Int. Cl.[4] ..... C11D 3/395

[52] U.S. Cl. ..... 252/99; 252/90; 252/135; 252/174; 252/DIG. 16; 252/187.32; 252/187.34; 134/26

[58] Field of Search ..... 252/99, 90, 91, 94, 252/135, 174.12, 156, 174, 187.32, 187.34; 134/26

[56] References Cited

U.S. PATENT DOCUMENTS

| | | | |
|---|---|---|---|
| 3,390,092 | 6/1968 | Keast et al. | 252/99 |
| 4,077,897 | 3/1978 | Gault | 23/313 AS |
| 4,219,435 | 8/1980 | Biard et al. | 252/99 |
| 4,219,436 | 8/1980 | Gromer et al. | 252/135 |
| 4,569,781 | 2/1986 | Fernholz et al. | 252/92 |
| 4,587,031 | 5/1986 | Kruse et al. | 252/99 |
| 4,828,745 | 5/1989 | Jeschke et al. | 252/99 |
| 4,828,749 | 5/1989 | Kruse et al. | 252/135 |

FOREIGN PATENT DOCUMENTS

| | | |
|---|---|---|
| 0000076 | 12/1978 | European Pat. Off. . |
| 0003769 | 9/1979 | European Pat. Off. . |
| 1617088 | 9/1974 | Fed. Rep. of Germany . |

*Primary Examiner*—Hoa V. Le

*Attorney, Agent, or Firm*—Ernest G. Szoke; Wayne C. Jaeschke; Real J. Grandmaison

[57] ABSTRACT

A detergent compact for dishwashing machines based on alkali metal metasilicates, pentalkali metal tripolyphosphates, active chlorine compound, and surfactant. The compact comprises a cold water-soluble tablet (1) or melt (2) of the metasilicates, tripolyphosphates and surfactant, and a warm water-soluble melt (1) or tablet (2) of the metasilicates, tripolyphosphates and active chlorine compound. The tablet (1) and melt (1) or melt (2) and tablet (2) are combined into a compact having varying solubility at varying water temperatures.

18 Claims, No Drawings

DETERGENT COMPACTS

This application is a continuation of application Ser. No. 144,784, filed Jan. 20, 1988, which is a continuation of Ser. No. 931,764, filed Nov. 17, 1986, both now abandoned.

BACKGROUND OF THE INVENTION

1. Field of the Invention

This invention relates to detergent compacts, more especially for dishwashing machines; to a process for their production; and to their use in the automatic prerinse and main wash cycles of domestic dishwashing machines.

2. Discussion of Related Art

German Pat. Application P 35 41 153.8, which has the same priority as the present application, describes block-form detergents, more especially for dishwashing machines, which are present in the form of multilayer structures wherein the individual layers dissolve at different rates in the time-temperature program of the dishwashing machine. In this way, one layer is intended to dissolve in the cold water of the prerinse cycle, while the other layer is only intended to dissolve with increasing temperature of the water in the main wash cycle.

German Pat. Application P 35 41 146.5 which also has the same priority as the present application, describes multilayer detergent tablets for dishwashing machines, which correspond in their composition and use to the same principles as described above.

DESCRIPTION OF THE INVENTION

It has now been found that highly effective detergent compacts, more especially for dishwashing machines, based on standard alkaline components, more especially from the group comprising alkali metal metasilicates and pentaalkali metal tripolyphosphates, and also standard additives of the active chlorine compound, surfactant and/or electrolyte type can be obtained by combining melts or tablets dissolving readily in cold water with tablets or melts which are largely unaffected by cold water and which only dissolve at the increasing water temperatures in the main-wash cycle, melts being combined with tablets of different solubility and tablets with melts of different solubility.

Other than in the operating examples, or where otherwise indicated, all numbers expressing quantities of ingredients or reaction conditions used herein are to be understood as modified in all instances by the term "about."

The cold water-soluble melt (2) layer for the prerinse cycle consists of cold water-soluble alkali metal donors, more especially alkali metal metasilicates hydrated to different degrees which incipiently soften and thoroughly wet dried-on food remains which cannot be removed from the dishes by the water mechanics alone. This layer has a dissolving rate in flowing water at 15° C. of from 25 to 40 grams per hour, and preferably of from 28 to 38 grams per hour.

The alkali metal metasilicates, preferably sodium metasilicates, of the melt (2) layer for the prerinse cycle are used in their anhydrous and, hence, most strongly alkaline form and in the form of the nonahydrate, the most readily water-soluble form. The mixture may also contain fractions of the pentahydrate. The prerinse detergent layer consists of from 20 to 100% by weight, and preferably of from 30 to 80% by weight of sodium metasilicate nonahydrate; from 0 to 60% by weight, and preferably from 10 to 50% by weight of sodium metasilicate pentahydrate; and, to obtain greater alkalinity, from 0 to 60% by weight, and preferably from 10 to 58% by weight, of anhydrous sodium m etasilicate.

Electrolytes may be added to the melt (2) layer for the prerinse cycle in order further to improve solubility, but also to optimize costs. Electrolytes are understood to be alkali metal salts of inorganic or organic acids, such as for example pentasodium tripolyphosphate, sodium sulfate, sodium acetate and sodium citrate. They may make up from 2 to 10% by weight, and preferably from 2 to 5% by weight, of the total weight of the detergent layer intended for the prerinse cycle.

The layer intended for the prerinse cycle may also be in tablet (1) form and may contain alkali metal metasilicte nonahydrate and pentaalkali metal tripolyphosphate containing from 7 to 22.4%, and preferably from 15 to 18% by weight, water of crystallization in a weight ratio of from 0:1 to 1:0 and preferably in a ratio of from 0.35:1 to 1:1, based on the anhydrous substances.

The melt (1) layer suitable for the main-wash cycle preferably contains for the most part sodium metasilicates and anhydrous pentasodium tripolyphosphate, and, in addition, other washing-active substances, such as an active chlorine compound. Its dissolving rate in flowing water at 15° C. is preferably below 25 grams per hour, and more especially in the range of from 24.5 to 15 grams per hour.

The quantity of anhydrous pentaalkali metal tripolyphosphate, preferably pentasodium tripolyphosphate, for the melt (1) layer intended for the main-wash cycle is from 5 to 50% by weight, and preferably from 5 to 45% by weight.

In the melt (1) layer intended for the main-wash cycle, the alkali metal metasilicates are advantageously used in the form of sodium metasilicate nonahydrate, sodium metasilicate hexahydrate, and sodium metasilicate pentahydrate. They are used in quantities of from 5 to 60% by weight, and preferably in quantities of from 10 to 50% by weight, expressed as anhydrous compounds. However, it is also possible to add the anhydrous compound, thereby increasing the content of washing-active substances.

The optimal weight ratio of pentasodium tripolyphosphate to sodium metasilicate, both anhydrous, for the melt layer for the main-wash cycle is from 2:1 to 1:2 and preferably from 1:1 to 1:1.7.

A tablet (2) form layer for the main-wash cycle rapidly dissolving at increasing temperatures may contain alkali metal metasilicate and pentaalkali metal tripolyphosphate in a ratio by weight of from 2:1 to 1:2 and preferably of from 1:1 to 1.7:1 and compounds containing active chlorine. The alkali metal metasilicate used in this layer is preferably the anhydrous product having a grain fraction of smaller than 0.8 mm. However, a mixture of anhydrous metasilicate and its nonahydrate in a ratio by weight of at most 1.2:1 may also be used.

The organic active chlorine donors in the tablet (2) or melt (1) layers intended for the main-wash cycle may be any of the various chlorinated compound of isocyanuric acid, such as preferably trichloroisocyanuric acid (TICA), but also Na/K-dichloroisocyanurate, Na-dichloroisocyanurate dihydrate (Na-DCC-2 $H_2O$), Na-monochloroamidosulfonate (N-chlorosulfamate) and sodium N-chloro-p-toluene sulfonamide ("Chloramine T"). Inorganic active chlorine donors such as, for example, chloride of lime, lithium or calcium hypochlorite, may also be used. They are used in quantities of from 0.2 to 4% by weight, and preferably in quantities of from 0.5 to 2% by weight, based on the active chlorine content which may be determined, for example, by iodometric titration, and on the layer as a whole.

The total water content of the tablet-form detergent layer may be from 11 to 35% by weight, and preferably from 18 to 30% by weight. It is preferably introduced by the water of crystallization of the alkaline-reacting compounds. Accordingly, any calculations of the water content must be based on those compounds.

An improvement in detergency in the prerinse cycle may be obtained by the addition of surfactants. Surfactants are generally incompatible with active chlorine compounds. However, they may be simultaneously used in a two-layer compact without affecting the chlorine donor providing both compounds are present separated from one another in another layer. The layer intended for the prerinse cycle may have a surfactant content of from 0.5 to 10% by weight and preferably from 1 to 5% by weight, based on the prerinse layer. The surfactant component may consist of any of the known low-foaming nonionic surfactants, such as ethoxylation products of long-chain alcohols and alkylphenols, the free hydroxyl groups of the polyethylene glycolether residue being replaceable by ether or acetal groups or by polypropylene glycolether residues in order to reduce the tendency towards foaming. Block polymers of ethylene oxide with propylene oxide are also suitable.

The tablet-form layers for the prerinse and mainwash cycles preferably contain as tabletting aids from 0.5 to 2.5% by weight, and preferably from 1 to 2% by weight of calcium hydrogen phosphate dihydrate to reduce disintegration, and from 1 to 5% by weight, and preferably from 2 to 3% by weight of sodium acetate, anhydrous to prevent adhesion to equipment.

The quantities in which these tabletting aids, which have no effect on detergency, are used may be increased beyond the ranges mentioned to enable modified formulations to be optimally tabletted. In addition, the sodium acetate content influences the solubility of the tablet. Larger quantities of sodium acetate lead to improved cold-water solubility in the prerinse cycle.

A further improvement in the solubility of the tablet layers may also be obtained, inter alia, by additions of other readily water-soluble salts, such as sodium chloride for example, although this is generally not necessary if the starting materials are suitably selected.

Although other standard tabletting aids, such as for example, lubricants to improve the tabletting properties, for example stearates, talcum, glycerides, etc., disintegrating agents such as cellulose derivatives, attapulgite (Mg-Al-silicate), etc., and other auxiliaries may also be used in principle, they are undesirable in terms of additional inert fillers. According to the invention, there is no need to use these otherwise standard auxiliaries in the production of tablet layers.

In order to show the mode of action of the two-layer compacts to the user, coloring of the compacts is possible, particularly in the case of the tablet layer for the prerinse cycle, although it has surprisingly been found that tabletted, colored raw materials may not dissolve as readily as tabletted, uncolored raw materials. The coloring of sodium metasilicate nonahydrate has the least influence on solubility. The dye may be dissolved or suspended in the surfactant and applied with the surfactant to the nonahydrate by mixing, for example in a Lodige mixer. It is even possible to introduce an aqueous dye solution with simultaneous drying by a fluidized-bed process. The colored nonahydrate may then be optionally mixed with other components and, after tabletting, gives a uniformly colored tablet layer.

Small quantities of dyes may also be added to the melt detergent layer intended for the prerinse cycle.

Determination of the dissolving rate of the substances for the individual layers of the detergent compacts was carried out in a laboratory apparatus after solidification of the raw material melts.

To this end, 15 g of the detergent to be tested in the form of a solid, compact block measuring approx. 25 ×25×15 mm were introduced into a 250 ml washing bottle according to DIN 12 596 of borosilicate glass. The washing bottle was then closed with a Drechsel stopper and secured in a ground-glass holder. Water having an average temperature corresponding to the prerinse cycle of 15° C. was passed through the bottle at a rate of 20 liters/hour (l/h) and the quantity which had dissolved under these conditions was determined by weighing after 15 minutes. The solubility behavior was defined as the dissolving rate in grams/hour (g/h) (cf. Table 1, quantities in % by weight).

The results show that the solubility behavior may be varied over a wide range through the particular choice of the starting materials. The addition of surfactants, which provide for improved wetting, has only a minimal effect on solubility. The same also applied to the addition of small quantities of electrolytes.

TABLE 1

(Quantities in % by Weight)

| Formulation Ingredients | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| Na-metasilicate .9 $H_2O$ | 36 | 44 | 50 | 100 | 70 | 70 | 50 | 40.3 | 40.3 | 45.9 | 40.3 | 40.3 | 40.3 | 40.3 | 40.3 |
| Na-metasilicate .5 $H_2O$ | 18 | 21 | — | — | — | — | — | 52.4 | 56.5 | 45.9 | 52.4 | 56.3 | 52.4 | 52.4 | 52.4 |
| Na-metasilicate anhydrous | 14 | — | — | — | 30 | 28 | 20 | — | — | — | — | — | — | — | — |
| Na-tripolyphos | 31 | 35 | 49 | — | — | — | 18 | — | — | — | — | — | — | — | — |
| Sodium sulfate | — | — | — | — | — | — | — | 4.0 | — | 4.6 | 4.0 | — | 4.0 | — | — |
| Sodium acetate | — | — | — | — | — | — | — | — | — | — | — | — | — | 4.0 | — |
| Sodium citrate | — | — | — | — | — | — | — | — | — | — | — | — | — | — | 4.0 |
| $C_{12}$–$C_{14}$-fatty alcohol + 5EO + 4PO | — | — | — | — | — | 2 | 2 | 3.3 | 3.2 | — | — | — | — | — | 3.3 |
| $C_{12}$–$C_{18}$-fatty alcohol + 2EO + 4PO | — | — | — | — | — | — | — | — | — | 3.6 | 3.3 | — | — | 3.3 | — |

TABLE 1-continued (Quantities in % by Weight)

| Formulation Ingredients | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| $C_{12}$–$C_{18}$ -fatty alcohol + 3EO + 6 PO | — | — | — | — | — | — | — | — | — | — | — | 3.2 | 3.3 | — | — |
| Trichloroisocyanuric acid (91% active chlorine) | 1 | — | 1 | — | — | — | — | — | — | — | — | — | — | — | — |
| Dissolving rate at 15° C. in g/h | 22.5 | 23 | 20 | 40 | 30 | 28 | 30 | 36 | 32 | 30 | 28.5 | 32.5 | 30 | 28 | 25 |
| | Main-wash Cycle | | | | | | | | | Prerinse Cycle | | | | | |

EO = moles ethylene oxide,
PO = moles propylene oxide

To determine the optimal composition of the differently soluble tablet layers, various tabletted detergent mixtures were tested for their solubility or rather decomposition properties in order subsequently to obtain a multilayer compact having the desired solubility profile by combination of a composition (tablet or fused block) showing good solubility in cold water with a composition (tablet or fused block) which only shows good solubility at increasing temperatures.

The desired solubility profile of a multilayer, more especially two-layer, compact is meant to be interpreted as substantially complete dissolution of the first layer, but only minimal dissolution of the second layer in the prerinse cycle and rapid and complete dissolution of the remaining compact at the increasing water temperatures in the main wash cycle of any standard domestic dishwashing machine.

The solubility (decomposition) of the tablets was tested as follows using an Engelsmann type E 70 universal tester:

Lying on a 2 mm mesh sieve cloth, the tablets were moved up and down in water at 20° C. in such a way that, at the highest point, the bottom of the tablets was just level with the water surface. The quantity of water was 800 grams and the number of up-and-down movements was 25 per minute. The time taken for each individual tablet to decompose or rather dissolve was measured or, where the dissolving times were longer than 5 minutes, the residues remaining on the sieve were reweighed after 5 to 10 minutes. The results of the tests are shown in Table 2 a) and b). It can be seen that the granulated raw materials sodium metasilicate nonahydrate and pentasodium tripolyphosphate having a water of crystallization content of preferably 15 to 18% by weight, may be used for the layer dissolving rapidly in cold water. A combination of the nonahydrate and the hydrated tripolyphosphate was particularly suitable. In the practical application of these tablets, providing their composition had been carefully coordinated and their degree of compression gauged accordingly, this layer decomposed with simultaneous dissolution of the sinking particles, i.e., hydrated tripolyphosphates and the metasilicate nonahydrate are highly soluble in water. No undissolved particles could be detected in the water pumped off after the prerinse cycle.

TABLE 2a

Decomposition properties of tablets of different composition (in % by weight) for the prerinse cycle

| Composition | 1 | 2 | 3 | 4 | 5 | 6 |
|---|---|---|---|---|---|---|
| Na-metasilicate anhydrous, smaller than 0.8 mm | — | — | — | — | — | — |

TABLE 2a-continued

Decomposition properties of tablets of different composition (in % by weight) for the prerinse cycle

| Composition | 1 | 2 | 3 | 4 | 5 | 6 |
|---|---|---|---|---|---|---|
| Na-metasilicate nonahydrate | — | 61.7 | 55.4 | — | 10 | — |
| $C_{12}$–$C_{18}$ fatty alcohol + 3 EO + 6 PO | — | — | — | — | — | 1.6 |
| Na-metasilicate nonahydrate, blue | — | — | — | 41.6 | — | 38.4 |
| Na-tripolyphosphate, anhydrous | — | 35.3 | — | — | — | — |
| Na-tripolyphosphate hydrate (15% $H_2O$) | 97 | — | 41.6 | — | — | — |
| Na-tripolyphosphate hydrate (18% $H_2O$) | — | — | — | 55.4 | 87 | 57.0 |
| Na-acetate anhydrous | 2 | 2 | 2 | 2 | 2 | 2 |
| $CaHPO_4.2\ H_1$ | 1 | 1 | 1 | 1 | 1 | |
| NaCl | — | — | — | — | — | — |
| Density | 1.34 | 1.28 | 1.21 | 1.26 | 1.22 | 1.27 |
| Hardness | >15 | 13 | 12 | >15 | >15 | >15 |
| Dissolved after minutes at 15° C. | 2.5 | 3.5 | 1 | 3 | 4 | 3 |
| Residue after 5 minutes at 15° C. | — | — | — | — | — | — |
| Residue after 10 minutes at 15° C. | — | — | — | — | — | — |

> = greater than

TABLE 2b

Decomposition properties of tablets of different composition (in % by weight) for the main-wash cycle

| Composition | 7 | 8 | 9 | 10 |
|---|---|---|---|---|
| Na-metasilicate, anhydrous, smaller than 0.8 mm | 33 | 58.4 | 61 | 45 |
| Na-metasilicate nonahydrate | 28 | — | — | 51 |
| Na-metasilicate nonahydrate, blue | — | — | | — |
| Na-tripolyphosphate anhydrous | 35 | 41.6 | 35 | — |
| Na-tripolyphosphate hydrate (15% $H_2O$) | — | — | — | — |
| Na-tripolyphosphate hydrate (18% $H_2O$) | — | — | — | — |
| Trichloroisocyanuric acid | 1 | 1 | 1 | 1 |
| Na-acetate, anhydrous | 2 | 3 | 2 | 2 |
| $CaHPO_4.2\ H_2O$ | 1 | 1 | 1 | 1 |
| NaCl | — | — | — | — |
| Density | 1.63 | 1.58 | 1.57 | 1.52 |
| Hardness | >15 | >15 | 13 | 12 |
| Dissolved after minutes at 15° C. | 20 | 20 | 20 | 20 |
| Residue after 5 minutes at 15° C. | 90 | 94 | 88 | 95 |
| Residue after 10 | 85 | 90 | 81 | 90 |

TABLE 2b-continued

| Decomposition properties of tablets of different composition (in % by weight) for the main-wash cycle | | | | |
|---|---|---|---|---|
| Composition | 7 | 8 | 9 | 10 |
| minutes at 15° C. | | | | |

> = larger than

On the basis of the results of the tests described in Tables 1 and 2a) and b), it was possible to prepare two-layer compacts in which a melt (2) or tablet (1) layer dissolved completely or almost completely in the prerinse cycle while the other melt (1) or tablet (2) layer dissolved only slightly in the prerinse cycle and then completely in the main-wash cycle of a domestic dishwashing machine.

In the preparation of the melts for the prerinse detergent layer, the sodium metasilicate nonahydrate is first heated to about 55° C. and dye is optionally added for identification. Sodium metasilicate pentahydrate and/or electrolyte and/or anhydrous sodium metasilicate and/or nonionic surfactant are then optionally added as quickly as possible with intensive stirring, after which stirring is continued until the melt and the solid particles dispersed therein are substantially homogeneous. In addition to the nonahydrate, the melt for the prerinse detergent layer preferably contains at least one of the other compounds mentioned.

In the preparation of the melts for the main-wash detergent layer, sodium metasilicate nonahydrate is again first heated to about 55° C., after which all other constituents containing water of hydration, particularly sodium metasilicate pentahydrate, then anhydrous pentasodium triphosphate, anhydrous sodium metasilicate and, finally, the active chlorine compounds are added with stirring or kneading and homogenized. Pourable melts preferably have viscosities of from about 500 to 1500 mPas, although higher and lower viscosities may also be processed.

The melts, in the quantities to be dispensed, are introduced into molds through a spray nozzle. In one preferred embodiment, the molds consists of a deep-drawn drawn part made, for example, of polyethylene, polypropylene or polyvinyl chloride which simultaneously serves as a pack. Using standard commercial machines, it is possible in a single operation to draw several molds from sheet-form film which may then be simultaneously filled through corresponding metering units.

The tabletting properties of raw material mixtures containing substantially anhydrous sodium metasilicates for forming tablet layers depend on their grain size distribution. A fine-grain fraction (smaller than 0.8 mm) provides for favorable tabletting properties while dust particles (smaller than 0.2 mm) and unsieved material (20 to 100% larger than 0.8 mm) lead to mixtures having poor tabletting properties. Where completely anhydrous metasilicates, for example, produced by a sintering or fusion process, are used, the tablets are mechanicaly stable even after prolonged storage. Where hydrothermally produced metasilicate having a residual moisture content of approximately 2% is used, the grain size distribution is not a crucial factor. However, after storage under room conditions, the surface of the tablets shows signs of weathering, large tablets also showing a tendency to crack. Accordingly, a residual moisture content of more than 2% in the metasilicate is undesirable.

In addition to the quality of the metasilicates used, the quality of the tripolyphosphate also affects the tabletting properties. Dust-fine products lead to poorer tabletting properties than slightly coarser types.

Metasilicates in anhydrous form and as the nonanhydrate and also the anhydrous tripolyphosphate are preferably used in the form of their sodium salts. They are present in the tabletting mixture for the main-wash cycle in a total quantity of from 88 to 98% by weight, and preferably in a total quantity of from 95 to 97% by weight.

It is also possible to incorporate nonionic surfactant in tablets for the prerinse cycle by using a colored premix of sodium metasilicate nonahydrate and nonionic surfactant without any adverse effect upon the solubility of the tablets.

The mixture of the fine-grained anhydrous metasilicates, the corresponding nonahydrates, the tripolyphosphates, active chlorine donors and tabletting aids may be tabletted in the presence of standard lubricants for the mold cavity. Depending on the construction of the machine, the lubricant is applied directly through bores in the cavity block, by spraying the bottom force or through lubricant-impregnated felt rings on the bottom forces. However, by virtue of their particularly favorable tabletting properties, the raw material mixtures according to the invention generally require no lubrication.

In order to avoid problems caused by sticking to the forces, it is advisable to coat the forces with plastics. Plexiglas or Vulkolan coatings have proved to be particularly favorable in this regard. However, favorable results have also been obtained with other standard materials.

The tabletting conditions should be optimized to obtain the desired solubility profile coupled with adequate tablet hardness. The bending strength of the tablets may serve as a measure of their hardness (method: cf. Ritschel, Die Tablette, Ed. Cantor, 1966, page 313). Tablets having a bending strength of greater than 12 kp and preferably greater than 15 kp are sufficiently stable under simulated transport conditions.

Corresponding tablet hardnesses were obtained for tabletting pressures of from 500 to 5000 kp/cm$^2$ and preferably from 1000 to 1500 kp/cm$^2$. Higher tabletting pressures reduce the dissolving rate. With different compositions, solubility differences may be redressed within limits through the choice of the tabletting pressure.

The compacts have a specific gravity of from 1.2 to 2 g/cm$^3$, and preferably of from 1.4 to 1.7 g/cm$^3$. The compression applied during tabletting produced changes in the specific volume which fell from 0.8–1.8 cm$^3$/g and preferably 1.0–1.4 cm$^3$/g, to 0.5–0.8 cm$^3$/g and preferably to 0.6–0.7cm$^3$/g.

The shape of the tablet can also affect its dissolving rate through the outer surface exposed to the water. For reasons of stability, cylindrical compacts having a diameter-to-height ratio of from 0.6 to 1.5:1 are produced.

The compacts may be produced with a total weight of from 40 to 60 g per compact. This corresponds to their preferred in-use concentration. It is of course also possible to produce lighter weight compacts, although in that case several compacts may have to be used at the same time.

The described compositions may be tabletted in known manner using standard commercial eccentric presses or rotary presses.

Subsequently, the tablet and fused-block formulations have to be combined with one another in such a way that one of the two forms is preferentially dissolved in the prerinse cycle while the other form is preferentially dissolved in the main-wash cycle. The tablet form is preferably used for the prerinse cycle.

To produce the detergent compact consisting of tablet and fused block, the main-wash detergent melt is poured into a mold, preferably in the form of deep-drawn parts which also serve as packs. A preformed tablet for the prerinse cycle is then pressed into the still liquid melt either by hand or by suitable mechanical means so that a firm union is established between the tablet and the fused block on solidification of the melt. A preferred embodiment is one wherein the tablet projects from the surface of the melt, thus making it easier for water to reach the tabletted part of the compact in the prerinse cycle. The detergent compact as a whole may then be sealed in the mold/pack, preferably by a removable film.

In another embodiment, it is also possible to use a tablet formulation which is poorly soluble under the conditions of the prerinse cycle for the main-wash cycle and then to provide the tablet prepared therefrom with a melt coating suitable for the prerinse cycle. The tablet for the main-wash cycle is then coated with a cold water soluble melt for the prerinse cycle, for example by pouring the melt over the tablet or by immersing the tablet in the melt. Suitable combinations may be made up from the formulations shown in Tables 1 and 2a) and b). However, many other formulations are also possible, providing they fall within the scope of the invention.

Since there are not currently any suitable dispensers for this method of using dishwashing detergents in standard commercial dishwashing machines, the compacts may be introduced after opening the machines into a zone which exposes the compacts to the dissolving power of the stream of tapwater, preferably into the cutlery basket of a domestic dishwashing machine, before the beginning of the prerinse cycle and the automatically controlled dishwashing process subsequently started.

Accordingly, the present invention also relates to the use of the detergent compacts for dishwashing in automatic domestic dishwashing machines, characterized in that the compacts are introduced after opening into a zone which exposes the tablets to the dissolving power of the stream of cold tapwater, for example by placing in the cutlery basket, before the beginning of the prerinse cycle and the automatically controlled dishwashing process subsequently started.

Even with difficult to remove soils, for example burnt-on milk or baked-on oat flakes, the dishes washed in this way are cleaner than conventionally treated dishes.

EXAMPLE

Formulation of the tablet mixture: by weight

| | |
|---|---|
| 57 | Pentasodium tripolyphosphate · 18% $H_2O$ |
| 39 | Sodium metasilicate nonahydrate |
| 1 | $C_{12}$–$C_{18}$ fatty alcohol + 5 EO + 4 PO |
| 0.08 | Alizarinbrillantreinblau GLW |
| 2 | Sodium acetate, anhydrous |
| 1 | $CaHPO_4.2H_2O$ |

Formulation of the melt:

| | |
|---|---|
| 36 | Sodium metasilicate nonahydrate |
| 14 | Sodium metasilicate pentahydrate |
| 18 | Sodium metasilicate anhydrous |
| 31 | Pentasodium tripolyphosphate, anhydrous |
| 1 | Trichloroisocyanuric acid |

The tablet premix was tabletted in an eccentric press to form 12.5 g tablets having a diameter of 30 mm and a height of approx. 13 mm. To prepare the melt, sodium metasilicate nonahydrate was first melted in a heated stirring vessel and then tempered at 57° C. Sodium metasilicate pentahydrate, pentasodium tripolyphosphate, anhydrous, and sodium metasilicate, anhydrous, were then successively incorporated as quickly as possible with intensive stirring. The solids-containing melt was homogenized and tempered at approx. 57° C. The trichloroisocyanuric acid was stirred into the melt before the beginning of casting.

Quantities of 37.5 g of the melt were introduced by a heated piston metering pump into each mold/pack (deep-drawn parts of 400 PVC-film, base area 36×36 $mm^2$, depth 25 mm, free surface 44×44 $mm^2$). One tablet per mold-pack was then pressed into the still liquid melt to such a depth that it still projected by about 2 to 4 mm from the surface of the melt. After solidification and cooling, a compact obtained in this way was placed in the cutlery basket of a domestic dishwashing machine. After the prerinse cycle, 36% of the compact had dissolved, the tablet having been almost completely dissolved out. The rest of the compact dissolved completely during heating of the water for the main-wash cycle.

Following the procedure described above, other comparable products may be obtained by combining suitable prerinse tablets (Table 1, 1 to 9) and main-wash fused blocks (Table 2b), 7 to 10). The extent to which the compact dissolves in the prerinse cycle may be influenced by variation of the fused block and tablet components.

In addition, a tablet formulation for the main wash (Table 1, 10 to 12) may be provided with a cold water-soluble melt layer (Table 2a), 1 to 6) by pouring the melt over the tablet or by immersing the tablet in the melt.

We claim:

1. A detergent composition in the form of a compact for a dishwashing machine having a pre-rinse cycle and a main wash cycle comprising a combined cold water-soluble tablet portion and a warm water-soluble solidified melt portion in block form, said tablet portion having a dissolving rate in flowing water at about 15° C. of from about 25 to about 40 grams per hour and being soluble in the pre-rinse cycle of said dishwashing machine, said tablet comprising sodium metasilicate nonahydrate and sodium tripolyphosphate containing from about 7 to about 22.4% by weight water of crystallization in a weight ratio of from about 0:1 to 1:0, based on anhydrous substances, said solidified melt portion having a dissolving rate in flowing water at about 15° C. of below about 25 grams per hour and being soluble in the main wash cycle of said dishwashing machine and substantially insoluble in said pre-rinse cycle, said solidified melt comprising from about 5% to about 50% by weight of sodium tripolyphosphate and from about 5% to about 60% by weight of sodium metasilicate, based on the weight of anhydrous compounds, said dissolving rate being measured on a compact having a weight of about 15 grams with a diameter-to-weight ratio of from about 0.6 to about 1.5:1.

2. A detergent composition in accordance with claim 1 wherein said tablet portion contains from about 0.5% to about 10% by weight of a low-foaming nonionic surfactant, based on the weight of said tablet.

3. A detergent composition in accordance with claim 1 wherein said solidified melt portion contains from about 0.2% to about 4% by weight of an active chlorine compound, based on the weight of said solidified melt.

4. A detergent composition in accordance with claim 1 wherein said tablet contains from about 0.5% to about 2.5% by weight of calcium hydrogen phosphate dihydrate and from about 1% to about 5% by weight of sodium acetate as a tabletting aid, based on the weight of said tablet.

5. A detergent composition in the form of a compact for a dishwashing machine having a pre-rinse cycle and a main wash cycle comprising a combined cold water-soluble solidified melt portion in block form and a warm water-soluble tablet portion, said solidified melt portion having a dissolving rate in flowing water at about 15? C. of from about 25 to about 40 grams per hour and being soluble in the pre-rinse cycle of said dishwashing machine, said solidified melt comprising from about 20% to about 100% by weight of sodium metasilicate nonahydrate, from 0 to about 60% by weight of sodium metasilicate pentahydrate, and from 0 to about 60% by weight of anhydrous sodium metasilicate based on the weight of said solidified melt, said tablet portion having a dissolving rate in flowing water at about 15° C. of below about 25 grams per hour and being soluble in the main wash cycle of said dishwashing machine and substantially insoluble in said pre-rinse cycle, said tablet comprising alkali metal metasilicate and sodium tripolyphosphate in a ratio by weight of from 2:1 to 1:2, said dissolving rate being measured on a compact having a weight of about 15 grams with a diameter-to-height ratio of from about 0.6 to about 1.5:1.

6. A detergent composition in accordance with claim 5 wherein said solidified melt portion contains from about 0.5% to about 10% by weight of a low-foaming nonionic surfactant, based on the weight of said solidified melt.

7. A detergent composition in accordance with claim 5 wherein said metasilicate present in said tablet comprises a mixture of anhydrous sodium metasilicate and sodium metasilicate nonahydrate in a weight ratio of about 1.2:1.

8. A detergent composition in accordance with claim 5 wherein said tablet portion contains from about 0.2% to about 4% by weight of an active chlorine compound, based on the weight of said tablet.

9. A detergent composition in accordance with claim 5 wherein said tablet contains from about 0.5% to about 2.5% by weight of calcium hydrogen phosphate dihydrate and from about 1% to about 5% by weight of sodium acetate as a tabletting aid, based on the weight of said tablet.

10. A dishwashing process comprising adding a detergent composition in the form of a compact to a dishwashing machine having a pre-rinse cycle and a main wash cycle, said compact comprising a combined cold water-soluble tablet portion and a warm water-soluble solidified melt portion in block form, said tablet portion having a dissolving rate in flowing water at about 15° C. of from about 25 to about 40 grams per hour and being soluble in the pre-rinse cycle of said dishwashing machine, said tablet comprising sodium metasilicate nonhydrate and sodium tripolyphosphate containing from about 7 to about 22.4% by weight water of crystallization in a weight ratio of from about 0:1 to 1.0, based on anhydrous substances, said solidified melt portion having a dissolving rate in flowing water at about 15° C. of below about 25 grams per hour and being soluble in the main wash cycle of said dishwashing machine and substantially insoluble in said pre-rinse cycle, said solidified melt comprising from about 5% to about 50% by weight of sodium tripolyphosphate and from about 5% to about 60% by weight of sodium metasilicate, based on the weight of anhydrous compounds, said dissolving rate being measured on a compact having a weight of about 15 grams with a diameter-to-height ratio of from about 0.6 to about 1.5:1, and starting said dishwashing machine.

11. A dishwashing process in accordance with claim 10 wherein said tablet portion contains from about 0.5% to about 10% by weight of a low-foaming nonionic surfactant, based on the weight of said tablet.

12. A dishwashing process in accordance with claim 10 wherein said solidified melt portion contains from about 0.2% to about 4% by weight of an active chlorine compound, based on the weight of said solidified melt.

13. A dishwashing process in accordance with claim 10 wherein said tablet contains from about 0.5% to about 2.5% by weight of calcium hydrogen phosphate dihydrate and from about 1% to about 5% by weight of sodium acetate as a tabletting aid, based on the weight of said tablet.

14. A dishwashing process comprising adding a detergent composition in the form of a compact to a dishwashing machine having a pre-rinse cycle and a main wash cycle, said compact comprising a combined cold water-soluble solidified melt portion in block form and a warm water-soluble tablet portion; said solidified melt portion having a dissolving rate in flowing water at about 15° C. of from about 25 to about 40 grams per hour and being soluble in the pre-rinse cycle of said dishwashing machine, said solidified melt comprising from about 20% to about 100% by weight of sodium metasilicate nonahydrate, from 0 to about 60% by weight of sodium metasilicate pentahydrate, and from 0 to about 60% by weight of anhydrous sodium metasilicate based on the weight of said solidified melt, said tablet portion having a dissolving rate in flowing water at about 15° C. of below about 25 grams per hour and being soluble in the main wash cycle of said dishwashing machine and substantially insoluble in said pre-rinse cycle, said tablet comprising alkali metal metasilicate and sodium tripolyphosphate in a ratio by weight of from 2:1 to 1:2, said dissolving rate being measured on a compact having a weight of about 15 grams with a diameter-to-height ratio of from about 0.6 to about 1.5:1, and starting said dishwashing machine.

15. A dishwashing process in accordance with claim 14 wherein said solidified melt portion contains from about 0.5% to about 10% by weight of a low-foaming nonionic surfactant, based on the weight of said solidified melt.

16. A dishwashing process in accordance with claim 14 wherein said metasilicate present in said tablet comprises a mixture of anhydrous sodium metasilicate and sodium metasilicate nonahydrate in a weight ratio of about 1.2:1.

17. A dishwashing process in accordance with claim 14 wherein said tablet portion contains from about 0.2% to about 4% by weight of an active chlorine compound, based on the weight of said tablet.

18. A dishwashing process in accordance with claim 14 wherein said tablet contains from about 0.5% to about 2.5% by weight of calcium hydrogen phosphate dihydrate and from about 1% to about 5% by weight of sodium acetate as a tabletting aid, based on the weight of said tablet.

* * * * *